US005238769A

United States Patent [19]

Bigelow et al.

[11] Patent Number: 5,238,769

[45] Date of Patent: Aug. 24, 1993

[54] MAGNETIC BRUSH CLEANING PROCESSES

[75] Inventors: Richard W. Bigelow, Webster; Grace T. Brewington, Fairport; Kristen M. Natale; Richard P. Germain, both of Webster, all of N.Y.

[73] Assignee: Xerox Corporation, Stamford, Conn.

[21] Appl. No.: 738,757

[22] Filed: Aug. 1, 1991

[51] Int. Cl.[5] ..... G03G 21/00

[52] U.S. Cl. ..... 430/125; 430/122

[58] Field of Search ..... 430/108, 122, 125; 355/296, 306, 305

[56] References Cited

U.S. PATENT DOCUMENTS

| | | | |
|---|---|---|---|
| 4,078,929 | 3/1978 | Gundlach | 96/1.2 |
| 4,155,883 | 5/1979 | Oguchi et al. | 252/62.1 P |
| 4,272,184 | 6/1981 | Rezanka | 355/15 |
| 4,514,485 | 4/1985 | Ushiyama et al. | 430/106.6 |
| 4,623,605 | 11/1986 | Kato et al. | 430/110 |
| 4,647,522 | 3/1987 | Lu | 430/110 |
| 4,652,509 | 3/1987 | Shirose et al. | 430/110 |
| 4,804,609 | 2/1989 | Imanaka et al. | 430/106.6 |

*Primary Examiner*—Marion E. McCamish
*Assistant Examiner*—Rosemary Ashton
*Attorney, Agent, or Firm*—E. O. Palazzo

[57] ABSTRACT

A process for extending the life of magnetic brush cleaners comprising carrier particles, a magnetic roll, and biased detone roll with a scraper by treating said carrier particles with a metal oxide.

8 Claims, No Drawings

MAGNETIC BRUSH CLEANING PROCESSES

BACKGROUND OF THE INVENTION

The present invention is generally directed to processes, and more specifically to processes for improving the life of known magnetic brush cleaners, and/or to processes which extend the usability of magnetic brush carrier cleaners by adding toners containing negatively charging surface additives such as AEROSIL® and metal oxides, such as titanium oxides. In one embodiment of the present invention there is provided a process for extending the life of magnetic brush cleaners selected for imaging and printing methods, such as xerographic imaging and printing methods. In an embodiment of the present invention, there is provided a process for extending the life, for example from about 10,000 developed copies to about 40,000 copies, of magnetic brush cleaners selected for color imaging processes, such as trilevel imaging methods as illustrated herein by the coating and/or mixing of metal oxides directly with the magnetic brush cleaner carrier particles, and/or by blending the metal oxides with the input or added toner material such that the metal oxides become mixed with the carrier particles selected for the magnetic brush cleaner when, for example, the untransferred toner from an imaging member is removed by the magnetic brush cleaner carrier and subsequently transported through the cleaner housing to the waste toner sump. Magnetic brush processes and components are known, reference for example the Xerox Corporation 1075 TM and 1090 TM imaging apparatuses.

The process of charging a photoresponsive imaging member to a single polarity and creating on it an image of at least three different levels, a trilevel imaging process to which the present invention is applicable, of a potential of the same polarity is described in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color and, in a subsequent development step, developed with negatively charged toner particles of a second color. Alternatively, charge patterns may be developed with a dry developer containing toners of two different colors in a single development step. Also of interest with respect to the trilevel process for generating images is U.S. Pat. No. 4,686,163, the disclosure of which is totally incorporated herein by reference.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may be comprised of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a known layered organic photoreceptor is employed, preferred potential ranges are from about −700 to about −850 volts for the high level of potential, from about −350 to about −450 volts for the intermediate level of potential, and from about −100 to about −180 volts for the low level of potential. These values can differ depending upon the type of imaging member selected.

Toner compositions with colored pigments are known. For example there is disclosed in U.S. Pat. No. 4,948,686, the disclosure of which is totally incorporated herein by reference, a process for the formation of two color images with a colored developer comprised of a first toner comprised of certain resin particles, such as styrene butadiene, a first pigment such as copper phthalocyanine, a charge control additive, colloidal silica and metal salts of fatty acid external surface additives, and a first carrier comprised of a steel core with, for example, a polymethyl methacrylate overcoating containing known conductive particles of, for example, carbon black, such as BLACK PEARLS TM carbon blacks available from Columbian Chemicals, present in an effective amount of, for example, from about 1 to about 40 weight percent of the coating, and wherein the coating weight is, for example, from about 0.2 to about 4 weight percent; and a second developer comprised of a black toner, a second charge additive and a steel core carrier with certain polymeric overcoatings, see claim 1 for example. Examples of colored toner pigments are illustrated in column 9, lines 10 to 26, and examples of charge additives for the toner are detailed in column 9, lines 27 to 43, of the aforementioned patent. For the black toner there can be selected the components as recited in columns 10 and 11, including charge additives such as distearyl dimethyl ammonium methyl sulfate, see column 11, lines 16 to 32. More specifically, there is illustrated in the 4,948,686 patent a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of a methyl terpolymer, polymethyl methacrylate, and a blend of from about 35 to about 65 percent by weight of polymethylmethacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of a chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate. Imaging members suitable for use with the above process may be of any type capable of maintaining three distinct levels of potential. Generally, various dielectric or photoconductive insulating material suitable for use in xerographic, ionographic, or other electrophotographic processes may be selected for the above process, and suitable photoreceptor materials include amorphous silicon, layered organic materials as disclosed in U.S. Pat. No. 4,265,990, the disclosure of which is totally incorporated herein by reference, and the like.

Processes for obtaining electrophotographic, including xerographic, and two-colored images, and the like are known, reference for example U.S. Pat. Nos. 4,264,185; 4,308,821; 4,378,415; 4,430,402; 4,594,302; 4,500,616; 4,524,117; 4,525,447; 4,562,129 and 4,640,883, the disclosures of which are each totally incorporated herein by reference. In the '883 patent there is illustrated, for example, a method of forming composite or dichromatic images which comprises forming on an imaging member electrostatic latent images having at least three different potential levels, the first and second latent images being represented, respectively, by a first potential and a second potential relative to a common background potential. The first and second images are developed by a first magnetic brush using two kinds of toners, at least one of which is magnetic, and both of which are chargeable to polarities opposite to each other with application to a developing electrode of a bias voltage capable of depositing the magnetic toner on the background potential area to deposit selectively the two toners on the first and second latent images and to deposit the magnetic toner on the background potential area, while collecting the deposited magnetic toner at least from the background potential area by second magnetic brush developing means.

In a patentability search report the following U.S. patents are recited: U.S. Pat. Nos. 4,155,883 which discloses a toner with a certain thermoplastic resin binder, see the Abstract; also disclosed is a curing reaction between the toner body powder and a micropowder, wherein the micropowder is formed of $TiO_2$, and the like, see column 2, line 67, and note the advantages in column 3; 4,623,605, which discloses a developer with a positive charge type carrier and a negative charge type toner, which toner can contain hydrophobic titanium oxide, see the Abstract; also see column 1, especially line 57, to column 3, especially lines 2 to 50; 4,647,522 which discloses a toner with oxide particles, such as titanium oxides, see the Abstract; also see column 1, especially line 55, and column 2, especially lines 1 to 30; 4,652,509, which discloses a toner with a hydrophobic titanium oxide; also, see column 2 for example; and 4,804,609, which discloses a developer with $SiO_2$ and/or magnetite for the primary purpose of removing talc from copy paper sheets, see column 2 for example.

Moreover, illustrated in U.S. Pat. No. 5,075,185, the disclosure of which is totally incorporated herein by reference, are developers, toners and trilevel imaging processes thereof. In an embodiment of the '185 patent, there is provided a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto. In an embodiment of the aforementioned patent, the first developer comprises, for example, a first toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; a first colored blue, especially PV Fast Blue pigment present in an effective amount of from, for example, about 1 to about 15 percent by weight, and preferably from about 5 to about 10 weight percent; an aluminum complex charge enhancing additive; and a second developer comprised of a second toner comprised of resin present in an effective amount of from, for example, about 70 to about 98 percent by weight, which resin can be selected from the group consisting of polysters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in an embodiment the black toner is comprised of 92 percent by weight of a styrene n-butyl methacrylate copolymer (58/42), 6 percent by weight of REGAL 330® carbon black, and 2 percent by weight of the charge enhancing additive cetyl pyridinium chloride.

Illustrated in U.S. Pat. No. 5,087,538, the disclosure of which is totally incorporated herein by reference, is a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin, a positively charging pigment, and a negatively charging pigment; (4) subsequently developing the high areas of potential by conductive magnetic brush development with a developer comprising a second developer comprised of carrier particles and a toner comprised of resin, black pigment, such as carbon black, and a charge enhancing additive; (5) transferring the developed two-color image to a suitable substrate; and (6) fixing the image thereto.

A magnetic brush cleaner illustrated herein and applicable to the process of the present invention in embodiments is disclosed in U.S. Pat. No. 3,580,673, the disclosure of which is totally incorporated herein by reference, which brush is designed to remove residual toner from an imaging member after the image has been transferred to paper. The major components of the magnetic brush cleaner are the cleaner roll and detone roll with a scraper. The cleaner roll is comprised of a thin shell aluminum outer roll rotating about a stationary magnet assembly. The outer roll is covered by a conductive carrier material that brushes against the imaging member. The cleaner roll is typically biased to about −170 volts so as to attract and remove positively charged residual toner from the surface of the imaging member by electrostatic forces. A detone roll rotates against the cleaner roll and is typically biased to about −320 volts so that toner is transferred from the carrier particles on the cleaner roll to the detone roll. The scraper mechanically removes toner from the detone roll. When the cleaner roll carrier particles are comprised, for example, of 0.175 percent of polyvinylidene fluoride polymer coated on Hoeganaes steel core the color developers of the present invention promote cleaning failure within 10,000 to 20,000 copies due to the buildup in the magnetic cleaning brush of input toner surface additives. The present invention extends the magnetic brush cleaner lifetime for the development and cleaning conditions described herein by about 30,000 copies in embodiments by mixing selected metal oxides with the cleaner carrier so as to obviate the deleterious effects of such additive accumulation.

SUMMARY OF THE INVENTION

It is a feature of the present invention to provide processes with many of the advantages illustrated herein.

It is another feature of the present invention to provide processes for extending the life of magnetic brush cleaners in various imaging systems, such as multicolor, like two-color images, and discharge area development images, that is for example wherein the background areas of a charged layered imaging member can be developed.

It is another feature of the present invention to provide processes for extending the life of magnetic brush cleaners in trilevel imaging methods and apparatuses.

It is still another feature of the present invention to provide cleaning processes that are resistent to the deleterious effects, such as toner redeposition from the cleaning member and high print background, thus permitting and enabling greater materials throughput.

Another feature of the present invention is to provide processes to extend or improve the existing partial functionality of magnetic brush cleaners in removing trilevel toner residue, thus eliminating the costly step of materials requalification usually required by selection of alternative cleaning techniques.

These and other features of the present invention can be accomplished by a process which comprises admixing metal oxide particles with magnetic brush cleaner carrier. In one embodiment, the present invention relates to a process for extending the life of magnetic brush cleaners by the addition of metal oxides, or the coating, for example 300 Angstroms in thickness, of metal oxides on the carrier, which carrier can be comprised of 0.175 percent of polyvinylidene fluroide polymer coated on Hoeganaes steel core, wherein the metal oxide can form a discontinuous layer of discrete particles on the cleaner carrier surface, and wherein lifetimes for magnetic brush cleaners present, for example, in the imaging systems mentioned herein, like trilevel xerography, and other known similar imaging systems is extended by 30,000 developed copies.

In one embodiment, the process of the present invention comprises blending a metal oxide with the input or freshly added toner added to a xerographic machine developer such that the metal oxide becomes mixed with the cleaner carrier, or coated onto the cleaner carrier during transport of the untransferred residual toner from the imaging member through the cleaning assembly to the waste toner sump. In this particular embodiment, no special apparatus, such as an auger assembly, is required to achieve mixing of the metal oxide with cleaner carrier. In one embodiment, 0.5 weight percent of the metal oxide was blended with the input toner. Typical ranges for metal oxide loading of the input toners for subsequent transport to the cleaner include from about 0.1 weight percent to about 2.0 weight percent. In general, the amount of metal oxide selected to achieve magnetic brush cleaner carrier life enhancement depends, for example, on the nature and the concentration of any material deleterious to the cleaner carrier. In this embodiment for the delivery of the metal oxide to the cleaner carrier, the metal oxide can enhance the functionality of the input material. The metal oxide can thus be mixed with the input toner for the purpose of achieving a means for passive transport to the cleaner.

The oxide coated toner particles, where the oxide is applied as a discrete particulate surface additive such as illustrated herein, can also be admixed with carrier particles to provide developers, and wherein the oxide can be transferred to the carrier. For example, about 1 to about 3 parts of toner by weight can be admixed with from about 100 to about 300 parts of carrier. Examples of suitable carriers and toners for input developers compatible with the imaging and cleaning processes are as illustrated herein.

Illustrative examples of suitable toner resins are styrene acrylates, styrene methacrylates, polyesters, cross-linked styrene methacrylates, and styrene butadienes, especially those with a high, such as from about 80 to about 98 weight percent styrene content, like the commercially available Goodyear PLIOLITES®, PLIOTONES®, and the like. The resin is present in an effective amount of from, for example, about 70 to about 98 percent by weight, which resin can be a styrene butadiene with from about 89 to about 92 weight percent of styrene. Typical toner resins include styrene butyl methacrylates, linear polyesters, styrene-butadiene polymers, particularly styrene-butadiene copolymers wherein styrene is present in an amount of from about 83 to about 93 percent by weight, and preferably about 88 percent by weight, and butadiene is present in an amount of from about 7 to about 17 percent by weight, and preferably about 12 percent by weight, such as resins commercially available as PLIOLITE® or PLIOTONE® from Goodyear. Also suitable are styrene-n-butylmethacrylate polymers, particularly those styrene-n-butylmethacrylate copolymers wherein the styrene segment is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable. Furthermore, suitable are styrene-n-butylmethacrylate polymers wherein the styrene portion is present in an amount of from about 50 to about 80 percent by weight, and preferably about 65 percent by weight, and the n-butylmethacrylate portion is present in an amount of from about 50 to about 20 percent by weight, and preferably about 35 percent by weight.

The toner contains a known pigment, such as carbon black, like REGAL 330 TM, cyan, magenta yellow, mixtures thereof and the like. The aforementioned pigments are present in various effective amounts, such as for example from about 2 to about 15 weight percent, and preferably from about 5 to about 10 weight percent.

Charge enhancing additives, which can be present in the toner in various effective amounts, such as from about 1 to about 20 weight percent, and preferably from about 0.5 to about 5 weight percent include known additives, such as cetyl pyridinium halide, especially the chloride, bisulfides, and mixtures thereof. Examples of specific charge additives include alkyl pyridinium halides, and preferably cetyl pyridinium chloride, reference U.S. Pat. No. 4,298,672, the disclosure of which is totally incorporated herein by reference, organic sulfates and sulfonates, reference U.S. Pat. No. 4,338,390, the disclosure of which is totally incorporated herein by reference, distearyl dimethyl ammonium methyl sulfate (DDAMS), reference U.S. Pat. No. 4,560,635, the disclosure of which is totally incorporated herein by reference, and the like. This toner can posses a negative or positive charge of from about 10 to about 45 microcoulombs per gram and preferably from about 15 to about 25 microcoulombs per gram, which charge is dependent on a number of known factors including the amount of charge enhancing additive present and the other components such as the toner resin, the pigment, the carrier core, and the coating selected for the carrier core, and an admix time of from about 15 to about 60 seconds and preferably from about 15 to about 30 seconds. Examples of a negative charge additives include the aluminum complexes, such as BONTRON E-88 TM and E-84 TM, available from Orient Chemical Company of Japan, and other known negative charge enhancing additives.

In the preparation of the toner compositions, normally the products obtained comprised of toner resin, pigment and charge enhancing additive can be subjected to micronization and classification, which classification is primarily for the purpose of removing undesirable fines, and substantially very large particles to enable, for example, toner particles with an average volume diameter of from about 5 to about 25 microns and preferably from about 10 to about 20 microns. The aforementioned toners may include as surface or external components additives in an effective amount of, for example, from about 0.1 to about 3 weight percent, such as colloidal silicas, such as AEROSIL R972®, metal salts, metal salts of fatty acids, especially zinc stearate, reference for example U.S. Pat. Nos. 3,590,000; 3,720,617; 3,655,374; 3,900,588 and 3,983,045, the disclosures of which are totally incorporated herein by reference, metal oxides and the like for the primary purpose of controlling toner conductivity and powder flowability. Examples of specific external additives of colloidal silica, include AEROSIL R972®, AEROSIL®R976®, AEROSIL R812®, and the like, available from Degussa, and metal salts or metal salts of fatty acids, such as zinc stearate, magnesium stearate, aluminum stearate, cadmium stearate, and the like, which additives may be blended on the surface of the toners. Generally, the silica is present in an amount of from about 0.1 to about 2 percent by weight, and preferably about 0.3 percent by weight of the toner, and the stearate is present in an amount of from about 0.1 to about 2 percent by weight, and preferably about 0.3 percent by weight of the toner. Varying the amounts of these two external additives can enable adjustment of the toner charge levels and developer conductivities. For example, increasing the amount of silica generally adjusts the triboelectric charge in a negative direction and improves admix times, which are a measure of the amount of time required for fresh toner to become triboelectrically charged after coming into contact with carrier. In addition, increasing the amount of stearate improves admix times, renders the developer composition more conductive, adjusts the triboelectric charge in a positive direction, and improves humidity insensitivity.

The carrier for the input developer in an embodiment of the present invention can be comprised of a steel, iron, ferrite, especially copper zinc ferrite, core with an average diameter of from about 25 to about 225 microns, and a coating thereover, such as for example selected from the group consisting of methyl terpolymer, polymethylmethacrylate, and a blend of from about 35 to about 65 percent by weight of polymethyl methacrylate and from about 35 to about 65 percent by weight of chlorotrifluoroethylene- or trichlorofluoroethylene-vinyl chloride copolymer wherein the coating contains from 0 to about 40 percent by weight of the coating conductive particles, such as carbon black, and wherein the coating weight is from about 0.2 to about 3 percent by weight of the carrier. The carrier for the black developer can be comprised of a steel core with an average diameter of from about 25 to about 225 microns and a coating thereover, such as for example selected from the group consisting of chlorotrifluoroethylene-vinyl chloride copolymer containing from 0 to about 40 percent by weight of conductive particles and wherein the coating weight is from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier. In embodiments, the carrier particles can be conductive, and exhibit in an embodiment of the present invention a conductivity of, for example, from about $10^{-14}$ to about $10^{-6}$, and preferably from about $10^{-11}$ to about $10^{-7}$ (ohm-cm)$^{-1}$. Conductivity is generally controlled by the choice of carrier core and coating by partially coating the carrier core, or by coating the core with a coating containing carbon black the carrier is rendered conductive. In addition, irregularly shaped carrier particle surfaces and toner concentrations of from about 0.2 to about 5 percent will generally render a developer conductive. Other carriers, including those with conductivities not specifically mentioned, may also be selected, including the carriers as illustrated in U.S. Pat. No. 4,883,736, the disclosure of which is totally incorporated herein by reference, and U.S. Pat. Nos. 4,937,166 and 4,935,326, the disclosures of which are totally incorporated herein by reference. The aforementioned carriers in one embodiment comprise a core with two polymer coatings not in close proximity in the triboelectric series.

More specifically, the carrier for the developers of the present invention generally can comprise a ferrite, iron or a steel core, preferably unoxidized, such as Hoeganaes Anchor Steel Grit, with an average diameter of from about 25 to about 215 microns, and preferably from about 50 to about 150 microns. These carrier cores can be coated with a solution coating of methyl terpolymer, reference for example U.S. Pat. Nos. 3,467,634 and 3,526,533, the disclosures of which are totally incorporated herein by reference, containing from 0 to about 40 percent by weight of conductive particles such as carbon black or other conductive particles as disclosed in U.S. Pat. No. 3,533,835, the disclosure of which is totally incorporated herein by reference, with the coating weight being from about 0.2 to about 3 percent by weight of the carrier, and preferably from about 0.4 to about 1.5 percent by weight of the carrier. Also, the carrier coating may comprise polymethylmethacrylate containing conductive particles in an amount of from 0 to about 40 percent by weight of the polymethylmethacrylate, and preferably from about 10 to about 20 percent by weight of the polymethylmethacrylate, wherein the coating weight is from about 0.2 to about 3 percent by weight of the carrier and preferably about 0.8 percent by weight of the carrier. Another carrier coating for the carrier of the colored developer comprises a blend of from about 35 to about 65 percent by weight of polymethylmethacrylate and from about 35 to about 65 percent by weight of chlorotrifluoroethylene-vinyl chloride copolymer, commercially available as OXY 461 TM from Occidental Petroleum Company and containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier. Excellent solid area development, and excellent line copy development can be obtained when the aforementioned carriers are selected in embodiments of the present invention. Also, the developer of the present invention with passivated toner can possess in embodiments stable electrical characteristics for extended time periods of up to six months. Carriers for the magnetic brush cleaner may be comprised of the aforementioned recited carriers, however, such a carrier is preferably comprised of 0.175 percent of polyvinylidene fluoride polymer coated on a Hoeganaes steel core.

Examples of metal oxides suitable for mixing with the magnetic brush cleaner carrier, directly or indirectly, such as by supplying pure oxide particles to the magnetic cleaning brush via an auger assembly, or by transporting the oxide to the magnetic brush cleaner indirectly in the form of a surface additive blended with the input toner include titanium dioxide, tin oxide, aluminum oxide and the like. One objective of mixing the metal oxide with the cleaner carrier is to provide a material which obviates or buffers the deleterious effects on carrier triboelectric charging arising from accumulation in the cleaner of input toner additives, such as toner flow aids, and the like. In general, the amount of metal oxide selected to enhance magnetic brush cleaner carrier life depends on the nature and amount of the deleterious material blended with the input toner. The amount of metal oxide added to the cleaner carrier can be from about 0.1 weight percent to about 2.0 weight percent relative to the weight of the untransferred or residual toner present in the cleaner housing of the xerographic machine. The preferred range is from about 0.5 weight percent to about 1.0 weight percent relative to the weight of the waste toner, from about 0.09 percent to about 0.5 percent by weight of 600 grams of cleaner carrier in the cleaner housing measured, for example, during a 35,000 copy print test as described herein.

Examples of imaging members selected for the processes of the present invention may be of any type capable of maintaining three distinct levels of potential. Generally, various dielectric or photoconductive insulating material suitable for use in xerographic, ionographic, or other electrophotographic processes may be used, such as amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can be comprised of areas of potential at −800, −400, and −100 volts. In addition, the levels of potential may comprises ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values can differ depending upon the type of imaging member selected.

The latent image comprising three levels of potential hereinafter referred to as a trilevel image may be formed on the imaging member by any of various suitable methods, such as those illustrated in U.S. Pat. No. 4,078,929, disclosure of which is totally incorporated herein by reference. For example, a trilevel charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In one embodiment, a trilevel charge pattern may be formed by means of a raster output scanner, optically modulating laser light as it scans a uniformly charged photoconductive imaging member. In this embodiment, the areas of high potential are formed by turning the light source off, the areas of intermediate potential are formed by exposing the imaging member to the light source at partial power, and the areas of low potential are formed by exposing the imaging member to the light source at full power.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

Also, the toners and developers of the present invention can be utilized in other color imaging processes, such as process color, and the like. One development process comprises a developer housing with a twin auger transport single magnetic brush design mounted in the approximate 6 o'clock orientation. The magnetic brush roll (developer roll) is about 30 millimeters in diameter, sandblasted for roughness, and preferably operates at about 1.5 times the speed of the photoreceptor or imaging member. The developer roll is spaced about 0.5 millimeter from the photoreceptor and is biased with a square wave 550 volt RMS 2.0 KHz AC bias added to the DC bias which is variable between 0 and −500 volts depending upon the photoreceptor discharge characteristics, and the desired xerographic developability established by the control algorithm. A stationary magnet is situated internal to the rotating developer roll sleeve, and is comprised of a ferrite with a designed magnetic pole configuration to satisfy the requirements of controlling the developer transport and developability. The developer flow (termed Mass on the Sleeve, or MOS) can be controlled by the location of a low permeability trimmer bar in the magnetic field at the point of trimming. Typically, the MOS is set at $33\pm3$ milligrams/cm$^2$ and is sensitive to the trim gap, toner concentration (TC) and developer tribo, hence, the developer housing has a toner concentration sensor as part of the process control circuitry. The twin augers in the developer housing sump transport the developer in opposite directions, first part the toner dispenser then to the developer pick up region of the developer roll. The augers have slits built into them in order to facilitate the mixing of the fresh toner added to the developer. Usually a number of latent images are formed and developed sequentially on the imaging member with the appropriate toner of the present invention, depending on the color desired for example.

The black positively charged toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number from about 30 to about 300, and preferably from about 30 to about 50, reference U.S. Pat. No. 4,883,736, the disclosure of which is totally incorporated herein by reference. Linear polymeric alcohols of this type are generally available from Petrolite Chemical Company as UNILIN®. The linear polymeric alcohol is generally present in an amount of from about 0.1 to about 1 percent by weight of the toner.

Black developer compositions for the present invention comprise in an embodiment from about 1 to about 5 percent by weight of the toner and from about 95 to about 99 percent by weight of the carrier. The ratio of toner to carrier may vary. For example, an imaging apparatus employed for the process of the present invention may be replenished with a colored developer comprising about 65 percent by weight toner and about 35 percent by weight carrier. The triboelectric charge of the black toners generally is from about −10 to about −30, and preferably from about −13 to about −18 microcoulombs per gram, although the value may be outside of this range. Particle size of the black toners is generally from about 8 to about 13 microns in volume average diameter, and preferably about 11 microns in volume average diameter, although the value may be outside of this range.

Coating of the carrier particles of the present invention may be by any suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling, or fluid bed coating in which the carrier particles are blown into the air by means of an air stream; and an atomized solution comprising the coating material and a solvent is sprayed onto the airborne carrier particles repeatedly until the desired coating weight, from about 1 to about 5 and preferably from about 1 to about 3 weight percent, is achieved.

The toners of the present invention may be prepared by processes such as extrusion, which is a continuous process that entails dry blending the resin, pigment, and charge control additive functioning as a passivating component, placing them into an extruder, melting and mixing the mixture, extruding the material, and reducing the extruded material to pellet form. The pellets are further reduced in size by grinding or jetting, and are then classified by particle size. In an embodiment of the present invention, toner compositions with an average particle size of from about 10 to about 25, and preferably from 10 to about 15 microns can be selected. External additives such as linear polymeric alcohols, silica like AEROSIL 972 ® or zinc stearate are then blended, in effective amounts, such as from about 0.1 to about 1 weight percent, with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention. Other known toner preparation processes can be selected including melt mixing of the components in, for example, a Banbury, followed by cooling, attrition and classification.

The disclosures of each of the U.S. patents, and copending patent applications mentioned herein are totally incorporated herein by reference.

The following examples are provided. All parts and percentages are by weight unless otherwise indicated.

IMAGING SYSTEM EXAMPLE

A test imaging system is assembled comprising (1) a means of charging an imaging member comprising a flexible belt-type layered organic photoreceptor with an aluminum substrate, a photogenerating layer in contact therewith of trigonal selenium, and a charge transport as the top layer comprised of N,N'-diphenyl-N,N'-bis(3-methyl phenyl) 1,1'-biphenyl-4,4'-diamine molecules, 55 weight percent, dispersed in the polycarbonate resin, 45 weight percent of MAKROLON ®, reference for example U.S. Pat. No. 4,273,846, the disclosure of which is totally incorporated herein by reference; (2) creating on the member a latent image comprising areas of high, intermediate and low potential, and more specifically areas of potential of about −760, −440 and −100 volts, respectively; (3) developing the areas of low potential with a developer supplied by a developer housing or container and comprising carrier prepared by solution coating a Hoeganaes Anchor Steel core with a particle diameter range of from about 75 to about 150 microns, available from Hoeganaes Company, with 0.8 part by weight of a coating comprising 20 parts by weight of Vulcan carbon black, available from Cabot Corporation, homogeneously dispersed in 80 parts by weight of polymethylmethacrylate, which coating was solution coated from a toluene solvent, and a toner comprising resin, pigment, surface additives and a charge control agent as illustrated herein specifically designed to triboelectrically charge negatively against said carrier to a tribo of about −18 microcoulombs per gram as determined by the known charge spectrograph in all instances; (4) transferring the resulting negatively charged developed image to a substrate; (5) fixing the image thereto; (6) a positive preclean corotron assembly to reverse the sign of the charge on the residual toner remaining on the imaging member after image transfer to paper from negative to positive, specifically in embodiments from about −18 microcoulombs per gram to about +18 microcoulombs per gram; and (7) cleaning the imaging member of residual untransferred toner with a magnetic brush cleaner comprising a carrier formulated with 0.175 percent polyvinylidene fluoride polymer coated on Hoeganaes steel core so as to cause this carrier to specifically and sufficiently triboelectrically charge negatively when brought into contact with the above positively charged toner to thereby remove the untransferred toner from the imaging member by electrostatic forces, and wherein the carrier can be coated with a metal oxide.

COMPARATIVE EXAMPLE I

A red developer composition was prepared as follows. Ninety two (92) percent by weight of styrene butadiene (89/11), 7 percent of the pigment LITHOL SCARLET D3700 TM obtained from BASF, and 1 percent by weight of the positive charge control agent distearyl dimethyl ammonium methyl sulfate for modification of the toner to a tribo of about −18 microcoulombs per gram, and for desirable admix characteristics, about 30 seconds, were melt blended in an extruder wherein the die was maintained at a temperature of between 130° and 145° C. and the barrel temperature ranged from about 80° to about 100° C., followed by micronization and air classification to yield toner particles of a size of 13 microns in volume average diameter. To the surface of the toner particles were then blended 0.5 percent by weight of AEROSIL R972 ® and 0.3 percent by weight of zinc stearate. Subsequently, carrier particles were prepared by solution coating a Hoeganaes Anchor Steel core with a particle diameter range of from about 75 to about 150 microns, available from Hoeganaes Company, with 0.8 part by weight of a coating comprising 20 parts by weight of Vulcan carbon black, available from Cabot Corporation, homogeneously dispersed in 80 parts by weight of polymethylmethacrylate, which coating was solution coated from a toluene solvent. The resulting red developer was then prepared by blending 97.5 parts by weight of the coated carrier particles with 2.5 parts by weight of the red toner in a Lodige Blender for about 10 minutes.

The red developer was introduced into the developer housing of the imaging system described in the above Imaging System Example. Standard imaging test patterns were run in machine tests extending to 50,000 prints. The cleaner became nonfunctional within 12,000 prints with the above input developer. Cleaning failure was manifest by the appearance of high background development on the prints, thus necessitating replacement of the cleaner carrier. This cleaner failure was attributed, it is believed, mainly to the accumulation of negatively charging AEROSIL R972 ® in the magnetic brush to the extent that the cleaner carrier would no longer triboelectrically charge to a magnitude sufficient to overcome the adhesion forces holding the untransferred toner to the imaging member.

COMPARATIVE EXAMPLE II

A red developer composition was prepared as follows. Ninety two (92) percent by weight of styrene butadiene (89/11), 7 percent of the pigment LITHOL SCARLET D3700 TM obtained from BASF, and 1 percent by weight of the positive charge control agent distearyl dimethyl ammonium methyl sulfate for modification of the toner to the above tribo (-18), and for desirable admix characteristics, about 30 seconds, were melt blended in an extruder wherein the die was maintained at a temperature of between 130° and 145° C. and the barrel temperature ranged from about 80° to about 100° C., followed by micronization and air classification to yield toner particles of a size of 13 microns in volume average diameter. To the surface of the toner particles were then blended 0.3 percent by weight of AEROSIL R972® and 0.3 percent by weight of zinc stearate. Subsequently, carrier particles were prepared by solution coating a Hoeganaes Anchor Steel core with a particle diameter range of from about 75 to about 150 microns, available from Hoeganaes Company, with 0.8 part by weight of a coating comprising 20 parts by weight of Vulcan carbon black, available from Cabot Corporation, homogeneously dispersed in 80 parts by weight of polymethylmethacrylate, which coating was solution coated from a toluene solvent. The resulting red developer was then prepared by blending 97.5 parts by weight of the coated carrier particles with 2.5 parts by weight of the red toner in a Lodige Blender for about 10 minutes.

The red developer was introduced into the developer housing of the imaging system described in the above Comparative Example I. Standard imaging test patterns were run in machine tests ranging from about 50,000 to 400,000 prints. Invariably, the cleaner carrier became nonfunctional within 21,000 prints with this input developer. Cleaner carrier failure or nonfunctional behavior was determined by appearance of high background development on the machine prints, and by the visual verification that residual untransferred toner on the imaging member was passing the cleaning zone. The machine tests were interrupted at these points and the cleaner carrier replaced, whereupon print background returned to an acceptable level.

COMPARATIVE EXAMPLE III

A yellow toner was prepared as follows: 94.5 percent by weight of PLIOTONE® polymer, 5 percent of the pigment FGL Yellow obtained from E.I. DuPont Company, and 0.5 percent by weight of the charge control agent potassium tetraphenyl borate for modification of the toner to the above tribo, and for desirable admix characteristics, were melt blended in an extruder as described in Comparative Examples I and II. The material was micronized and air classified to yield particles of a size 11.5 microns in volume average diameter.

To the surface of the toner was blended 0.3 percent by weight of AEROSIL R972® and 0.3 percent by weight of zinc stearate. Carrier particles were formulated and a yellow input developer subsequently prepared as described in Comparative Examples I and II.

The yellow developer was introduced into the developer housing of the imaging system described in the Imaging System Example and tested as described in Comparative ExampleS I and II. The imaging test began with a fresh cleaner carrier charge comprised of 600 grams of bare carrier. The cleaner became nonfunctional at 9,000 prints with this developer. Cleaner carrier failure or nonfunctional behavior was determined by the appearance of high background development on the machine prints, and by the visual verification that residual untransferred toner on the imaging member was passing the cleaning zone. The print test was interrupted at the point of cleaning failure and the aged and nonfunctional cleaner carrier emptied from the cleaner housing. A fresh carrier charge comprised of 600 grams of bare carrier was added to the cleaner and the print test continued. Print background was eliminated with the new carrier, and there was no residual untransferred toner passing the cleaner. The cleaner carrier again became nonfunctional after 14,500 additional prints. Failure was again manifest by high print background and the visual verification of untransferred toner passing the cleaner. The cleaner carrier was again replaced with 600 grams of new carrier and the test continued. Print quality was again restored, and there was no untransferred toner passing the cleaning station. The cleaner carrier again became nonfunctional after an additional 17,700 prints. Cleaning failure was again manifest by high print background and the visual verification of untransferred toner passing the cleaner.

EXAMPLE IV

A yellow toner was prepared as follows. Ninety four (94) percent by weight of PLIOTONE® polymer, 5 percent of the pigment FGL Yellow obtained from E.I. DuPont Company, and 1 percent by weight of the positive charge control agent distearyl dimethyl ammonium methyl sulfate for modification of the toner to a tribo or charge level of about −17 microcoulombs per gram, and for desirable admix characteristics were melt blended in an extruder as described in Comparative Examples I and II. The material was micronized and air classified to yield toner particles of 11.5 microns in volume average diameter as determined by Coulter Counter measurement. To the surface of the toner were added 0.3 percent by weight AEROSIL R972®, 0.3 percent by weight of zinc stearate and 0.5 percent by weight of 300.0 Ångstroms of titanium dioxide(P25 available from Degussa) by blending for 15 minutes in a Lightnin' Labmaster II Blender. Carrier particles were prepared by solution coating a Hoeganaes Anchor Steel core with a particle diameter range of from about 75 to about 150 microns, available from Hoeganes Company, with 0.8 part by weight of a coating comprising 20 parts by weight of Vulcan carbon black, available from Cabot Corporation, homogeneously dispersed in 80 parts by weight of polymethylmethacrylate, which coating was solution coated from a toluene solvent. A color input developer formulated as described in Comparative Example III.

The resulting developer with the toner containing the titanium dioxide was introduced into the developer housing of the imaging system described in the Imaging System Example, and wherein the metal oxide becomes mixed with the magnetic brush cleaner carrier, or coated onto the cleaner carrier during transport of the untransferred residual toner from the imaging member through the cleaning assembly to the waste toner sump. A fresh imaging member and cleaner carrier charge was installed at the beginning of the test. Standard imaging patterns were run in a 35,000 print test. The developer with the above titanium dioxide caused no degradation of parent input developer attributes during the 35,000 print test. Cleaning remained fully functional throughout the 35,000 print test. Print background began and remained low, and there was no visual evidence for untransferred toner passing the cleaning station. Cleaner carrier electrical properties were monitored and found to be stable at a nominal level. There was no evidence to suggest cleaner carrier degradation as manifest by waste toner redeposition from the cleaner to the imaging member, such as observed with input developer not containing titanium dioxide.

EXAMPLE V

Color developer compositions containing surface additives such as AEROSIL R972®, or other strong negatively charging material such as AEROSIL R812® or AEROSIL R976®, can be prepared following the procedures of the above Examples, and introduced into the developer housing of the imaging system of the Imaging System Example. A metal oxide, such as titanium dioxide, can be introduced separately into the magnetic brush of the cleaner to achieve the benefits of the present invention. For example, the metal oxide can be mixed directly with the active cleaner carrier via an auger assembly at any rate sufficient to inhibit the deleterious effects on cleaning resulting from accumulation of said nagatively charging toner surface additives. The rate of such direct mixture would be dependent on the nature and amount of surface additive blended with the input toner. Waste toner transported through the cleaner to the waste toner sump would scavenge sufficient metal oxide by triboelectric or other interactions to prevent excessive accumulation of the metal oxide in the magnetic brush of the cleaner. In this manner the advantages of the present invention can be achieved.

Other embodiments and modifications of the present invention may occur to those skilled in the art subsequent to a review of the present application; these embodiments and modifications, as well as equivalents thereof, are also included within the scope of this invention.

What is claimed is:

1. A process for extending the life of magnetic brush cleaners of from between about 10,000 copies to about 40,000 copies by coating, carrier particles with a metal oxide, and adding the resulting treated carrier to an imaging apparatus containing said cleaner comprised of carrier particles, a magnetic roll, and biased detone roll.

2. A process in accordance with claim 1 wherein the metal oxide is titanium dioxide, tin oxide, or aluminum oxide.

3. A process in accordance with claim 1 wherein the metal oxide is selected in an amount of from about 0.1 weight percent to about 2.0 weight percent relative to the weight of the waste or residual untransferred toner from the imaging member present in the magnetic cleaner brush.

4. A process in accordance with claim 1 wherein the cleaner carrier is comprised of a steel, iron, or ferrite core.

5. A process in accordance with claim 4 wherein the core is coated with a polymer or mixture of polymers prior to the coating with the metal oxide.

6. A process in accordance with claim 5 wherein the carrier coating is a polymer.

7. A process in accordance with claim 5 wherein the carrier coating is comprised of a mixture of polymers.

8. A process in accordance with claim 1 wherein the magnetic brush is comprised of a steel core coated with 0.175 percent of polyvinylidene fluoride polymer.

* * * * *